US009676466B2

(12) United States Patent
Kerkeni et al.

(10) Patent No.: US 9,676,466 B2
(45) Date of Patent: Jun. 13, 2017

(54) NAVAL PLATFORM PROVIDED WITH AT LEAST ONE HULL COMPRISING STEERABLE THRUSTERS

(71) Applicant: DCNS, Paris (FR)

(72) Inventors: Sofien Kerkeni, Nantes (FR); Xavier Dal Santo, Nantes (FR)

(73) Assignee: DCNS, Paris (FR)

( * ) Notice: Subject to any disclaimer, the term of this patent is extended or adjusted under 35 U.S.C. 154(b) by 0 days.

(21) Appl. No.: 15/026,572

(22) PCT Filed: Oct. 1, 2014

(86) PCT No.: PCT/EP2014/071058

§ 371 (c)(1),
(2) Date: Mar. 31, 2016

(87) PCT Pub. No.: WO2015/049296

PCT Pub. Date: Apr. 9, 2015

(65) Prior Publication Data

US 2016/0244138 A1 Aug. 25, 2016

(30) Foreign Application Priority Data

Oct. 1, 2013 (FR) ..... 13 59479

(51) Int. Cl.

| | |
|---|---|
| ***B63B 35/08*** | (2006.01) |
| ***B63H 25/46*** | (2006.01) |
| ***B63H 25/42*** | (2006.01) |
| ***B63B 35/44*** | (2006.01) |
| ***B63B 43/18*** | (2006.01) |

(Continued)

(52) U.S. Cl.

CPC ..... *B63H 25/46* (2013.01); *B63B 35/08* (2013.01); *B63B 35/44* (2013.01); *B63B 43/18* (2013.01); *B63B 49/00* (2013.01); *B63H 25/42* (2013.01); *B63H 21/17* (2013.01); *B63H 2025/425* (2013.01)

(58) Field of Classification Search

CPC ..... B63B 35/08; B63H 25/46
USPC ..... 114/151
See application file for complete search history.

(56) References Cited

U.S. PATENT DOCUMENTS 6,848,382 B1 * 2/2005 Bekker ..... B63H 20/00 114/144 B
8,210,115 B2 * 7/2012 Frigstad ..... B63B 35/4413 114/265

(Continued)

FOREIGN PATENT DOCUMENTS

DE 10 2007 014 014 A1 9/2008

*Primary Examiner* — Lars A Olson
*Assistant Examiner* — Jovon Hayes
(74) *Attorney, Agent, or Firm* — Knobbe, Martens, Olson & Bear, LLP

(57) ABSTRACT

This naval platform (1) of the type including at least one hull (2) equipped with steerable thrusters (3, 4, 5, 6) distributed on the latter and means (7, 8, 9, 10, 11) for controlling the orientation and the actuation of the latter, is characterized in that the control means comprise means (12) for illustrating at least one portion of the surface of the water around the naval platform (13) in proximity to the latter, associated with the means (14, 15, 16, 17, 18, 19, 20, 21) for controlling at least one portion of the steerable thrusters (3, 4, 5, 6) for generating and directing a waterflow towards this portion of the surface.

12 Claims, 1 Drawing Sheet

(51) Int. Cl.
*B63B 49/00* (2006.01)
*B63H 21/17* (2006.01)

(56) References Cited

U.S. PATENT DOCUMENTS

| | | | | |
|---|---|---|---|---|
| 8,523,483 | B2 * | 9/2013 | Nedwed | B63B 35/08 114/121 |
| 9,067,664 | B2 * | 6/2015 | Yuet | B63H 25/42 |
| 9,180,951 | B2 * | 11/2015 | Hitachi | B63H 25/42 |
| 2009/0271054 | A1 * | 10/2009 | Dokken | G01S 13/9307 701/21 |
| 2010/0126401 | A1 * | 5/2010 | Kokkinis | B63B 21/507 114/144 B |
| 2011/0022316 | A1 * | 1/2011 | Bendito Vallori | B63H 21/22 701/301 |
| 2012/0316769 | A1 * | 12/2012 | Gagliardi | G08G 3/02 701/300 |
| 2016/0244138 | A1 * | 8/2016 | Kerkeni | B63H 25/42 |

* cited by examiner

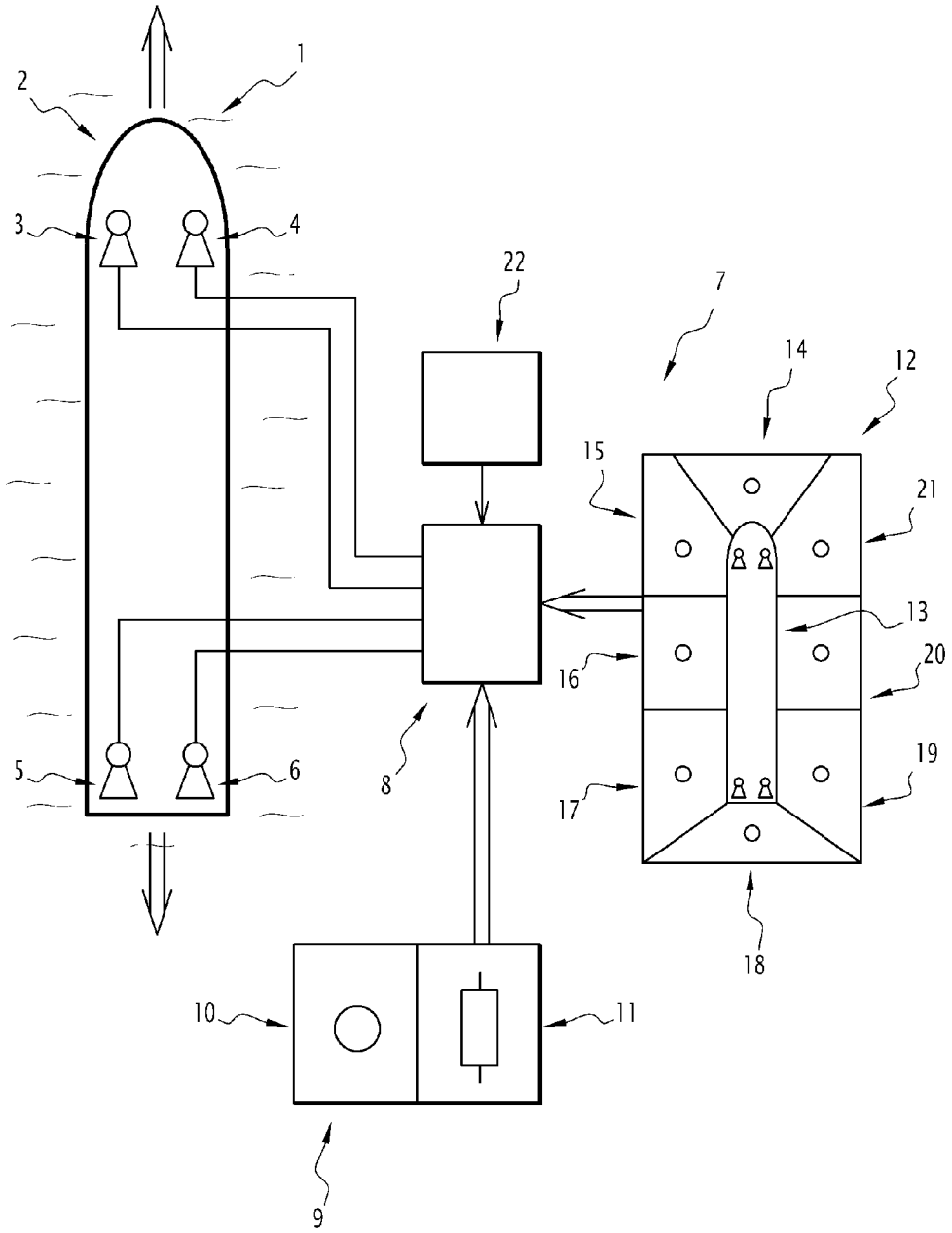
1
2
3
4
5
6
7
8
9
10
11
12
13
14
15
16
17
18
19
20
21
22

NAVAL PLATFORM PROVIDED WITH AT LEAST ONE HULL COMPRISING STEERABLE THRUSTERS

FIELD OF THE INVENTION

The present invention relates to a naval platform.

Most particularly, the invention relates to a naval platform which includes at least one hull fitting out with steerable thrusters distributed over and more particularly under the latter and the associated with means for controlling the orientation and the activation of these thrusters.

BACKGROUND OF THE INVENTION

Generally, these means for controlling thrusters are for example activated by a maneuvering operator for not only controlling the direction of displacement but also the displacement speed of this platform in a given direction.

It is not known that platforms of this type also equipped with particular functions allowing stabilization in position and further an action on the environment of the platform for pushing back objects such as blocks of ice or other objects and thus avoiding that the latter hit or damage the hull.

Platforms equipped with means of this nature are for example described in documents US 2010/0126401 and EP 2 167 374.

However these platforms are extremely difficult to control and the control means require a rather long reaction time which may be expressed by putting the platform in danger.

SUMMARY OF THE INVENTION

The object of the invention is therefore to solve these problems by proposing extremely simple and fast means for controlling the operation of these platforms.

For this purpose, the object of the invention is a naval platform of the type including at least one hull equipped with steerable thrusters distributed on the latter and with means for controlling the orientation and the activation of the latter, characterized in that the control means comprise means for illustrating at least one portion of the surface of the water around the naval platform in proximity to the latter, associated with the means for controlling the operation of at least one portion of the steerable thrusters for generating and directing a waterflow towards this portion of the surface.

According to other features of the platform according to the invention, taken alone or as a combination:

- the control means are adapted for controlling the operation of at least one other portion of the thrusters in order to generate a thrust for balancing the frosted generated by the waterflow;
- the illustration means represent several sectors of the surface of the water around the naval platform in proximity to the latter, each of which is associated with means for controlling the operation of at least one portion of the steerable thrusters for directing a waterflow towards this sector;
- the illustration and control means comprising a touch screen on which is illustrated a pictogram illustrating the platform and around the latter areas forming touchpads for controlling the thrusters;
- areas forming touchpads for controlling the thrusters are provided around the stern and prow of the platform;
- areas forming touchpads for controlling the thrusters are provided all around the platform;

- the control means comprise means for storing data for controlling the orientation and power of each thruster;
- the control means comprise means for storing data for controlling the orientation and power of each thruster for each defined sector;
- the steerable thrusters comprise electric pods.

BRIEF DESCRIPTION OF THE DRAWINGS

FIG. 1. Illustration of a block diagram as seen from the top illustrating the structure and the operation of a naval platform equipped with control means.

DETAILED DESCRIPTION OF THE PREFERRED EMBODIMENT

A naval platform such as any ship or boat designated by the general reference 1 is actually illustrated In this FIGURE.

The latter is illustrated schematically in a top view and includes at least one hull designated by the general reference 2 equipped with steerable thrusters distributed on and more particularly under the latter.

Thus for example in this FIGURE are illustrated four steerable thrusters designated by the references 3, 4, 5 and 6?

The platform is also equipped with means for controlling the orientation and the activation of these steerable thrusters, these means being designated by the general reference 7 in this FIGURE.

In fact and conventionally, these control means 7 comprise a control unit and designated by the general reference 8, associated with means forming a man/machine interface made available for example to a maneuvering operator, designated by the general reference 9, and for example a lever for controlling orientation designated by the general reference 10 and a power control handle designated by the general reference 11.

This then gives the possibility for example to this maneuvering operator of controlling the movements of the platform notably in direction and in speed.

According to the invention, these control means also comprise means for illustrating at least one portion of the surface of the water around the naval platform in proximity to the latter, associated with means for controlling the operation of at least one portion of the steerable thrusters of this platform, for generating and directing a waterflow towards this portion of the surface.

In fact, these control means for example comprise a touch screen designated by the general reference 12 in this FIGURE, in which is illustrated a pictogram 13 illustrating the platform as schematically seen from the top and around the latter or portions of the latter areas forming touchpads for controlling the thrusters, these areas being respectively designated by the references 14, 15, 16, 17, 18, 19, 20 and 21 in the FIGURE.

As this is illustrated, touchpad-forming areas for controlling the thrusters are provided all around the platform and of course it is obvious that in an alternative embodiment, such areas may be a really provided around the stern and prow of the platform for example.

These illustration means then illustrate sectors of the surface of the water around the naval platform in proximity to the latter, and each of which is associated with command orders for means controlling the operation of at least one portion of the steerable thrusters of the platform, in order to direct a waterflow towards this sector of the environment.

In fact, these command orders entered by the maneuvering operator are then transmitted to the control unit 8, the latter being associated with data storage means, designated by the general reference 22 in this FIGURE, into which are recorded or calculated in real time depending on the operating conditions, orders for controlling the orientation and the power of each thruster for each thereby defined sector.

This then gives the possibility by controlling at least one portion of the steerable thrusters of the platform, of generating and directing a water flow towards the selected portion of the surface around the platform and as designated by the operator by pressing on the illustrated sectors or touchpads, for pushing back a object such as a block of ice which may collide with the platform.

Of course, the control means may also be adapted for controlling the operation of at least one other portion of the thrusters in order to generate a thrust for balancing the thrust generated by the waterflow in order to retain the time-dependent movement and to maintain the platform in position.

This is for example illustrated in this FIGURE where it is seen that if the operator for example activates the touchpad 14, the thrusters 3 and 4 are driven so as to generate and direct a waterflow towards the front of the platform.

In the same time, the thrusters 5 and 6 may be driven for generating a thrust towards the rear of the platform for balancing the thrust generated by the waterflow for example in order to maintain the platform in position.

Of course it is obvious that very many of the embodiments may be contemplated, notably at the touchscreen.

It will also be noted that the steerable thrusters may for example be formed with electric pods but other propulsion units may be contemplated.

It is then conceivable that such a structure has a certain number of advantages notably at the steering simplicity and at the maneuvering ease and rapidity which results therefrom for the platform and this by increasing safety correspondingly.

The invention claimed is:

1. A naval platform comprising at least one hull equipped with steerable thrusters distributed over the hull and a controller configured to control orientation and activation of the steerable thrusters, wherein the controller comprises a display configured to illustrate at least one portion of a surface of the water around the naval platform in proximity to the naval platform, wherein the display comprises areas that are configured to control at least one portion of the steerable thrusters in order to generate and direct a waterflow towards the at least one portion of the surface and wherein the display is configured to illustrate several sectors of the surface of the water around the naval platform in proximity to the naval platform, each one of the several sectors of the surface of the water being associated with areas on the display that are configured to control the operation of at least one portion of the steerable thrusters in order to direct a waterflow towards the several sectors of the surface of the water around the naval platform.

2. The naval platform according to claim 1, wherein other areas on the display are configured to control operation of at least one other portion of the thrusters in order to generate a thrust that balances the thrust generated by the waterflow.

3. A naval platform comprising at least one hull equipped with steerable thrusters distributed over the hull and a controller configured to control orientation and activation of the steerable thrusters, wherein the controller comprises a display configured to illustrate at least one portion of a surface of the water around the naval platform in proximity to the naval platform, wherein the display comprises areas that are configured to control at least one portion of the steerable thrusters in order to generate and direct a waterflow towards the at least one portion of the surface, wherein the display and controller comprises a touchscreen on which is illustrated a pictogram illustrating the platform and areas around the platform, and wherein the areas around the platform on the touchscreen comprise touchpads configured to control the thrusters.

4. The naval platform according to claim 3, wherein the areas comprising the touchpads configured to control the thrusters are provided around the stern and the prow of the platform.

5. The naval platform according to claim 3, wherein the areas comprising touchpads configured to control the thrusters are provided all around the platform.

6. The naval platform according to claim 1, wherein the controller comprises data storage configured to store orientation and power control data of each thruster.

7. The naval platform according to claim 1, wherein the controller comprises data storage configured to store orientation and power control data on each thruster for each defined sector.

8. The naval platform according to claim 1, wherein the steerable thrusters comprise electric pods.

9. The naval platform according to claim 3, wherein other areas on the display are configured to control operation of at least one other portion of the thrusters in order to generate a thrust that balances the thrust generated by the waterflow.

10. The naval platform according to claim 3, wherein the controller comprises data storage configured to store orientation and power control data of each thruster.

11. The naval platform according to claim 3, wherein the controller comprises data storage configured to store orientation and power control data on each thruster for each defined sector.

12. The naval platform according to claim 3, wherein the steerable thrusters comprise electric pods.

* * * * *